US005237902A

United States Patent [19]

Hamanaga

[11] Patent Number: 5,237,902

[45] Date of Patent: Aug. 24, 1993

[54] WIND INSTRUMENT WITH LINK MECHANISM FOR TRANSMITTING LEVER ACTION TO ROTARY VALVE UNIT OR KEY

[75] Inventor: Shinji Hamanaga, Shizuoka, Japan

[73] Assignee: Yamaha Corporation, Japan

[21] Appl. No.: 830,655

[22] Filed: Feb. 4, 1992

[30] Foreign Application Priority Data

Feb. 7, 1991 [JP] Japan ..... 3-38161

[51] Int. Cl.[5] ..... G10D 9/00

[52] U.S. Cl. ..... 84/386; 84/390; 84/393; 251/279; 403/24; 411/302; 411/338

[58] Field of Search ..... 84/390, 391, 392, 393, 84/382, 386; 251/232, 236, 279; 403/119, 24, 146, 322, 325; 411/302, 303, 338, 339, 366, 324, 929.1

[56] References Cited

U.S. PATENT DOCUMENTS 2,036,356 4/1936 Pedler ..... 84/382
3,237,504 3/1966 Leblanc ..... 84/382
4,297,063 10/1981 Hart ..... 411/338

FOREIGN PATENT DOCUMENTS 3933135 4/1990 Fed. Rep. of Germany ..... 84/390

*Primary Examiner*—Michael L. Gellner
*Assistant Examiner*—Patrick Stanzione
*Attorney, Agent, or Firm*—Ostrolenk, Faber, Gerb Soffen

[57] ABSTRACT

A wind instrument is equipped with rotary valve units or keys for changing the length of vibrative air column, and a link mechanism transmits a lever action to the rotary valve unit or the key, wherein a joint incorporated in the link mechanism comprises a shaft member having an external thread and coupled with the manipulating lever, an adjustable screw member with an internal thread, a tubular member actuating the rotary valve unit or the key and retained by the adjustable screw meshed with the external thread, and an elastic member inserted between a bottom surface of the tublar member and a leading end of the external thread portion so that gaps on both sides of the tubular member are adjustable, thereby allowing the tubular member to smoothly rotate.

8 Claims, 7 Drawing Sheets

WIND INSTRUMENT WITH LINK MECHANISM FOR TRANSMITTING LEVER ACTION TO ROTARY VALVE UNIT OR KEY

FIELD OF THE INVENTION

This invention relates to a wind instrument and, more particularly, to a link mechanism coupled between a lever and a rotary valve unit or a key.

DESCRIPTION OF THE RELATED ART

FIG. 1 shows a typical example of the link mechanism coupled between a manipulating lever 1 and a rotary valve 2, and the link mechanism largely comprises a rotary joint 3 and a connecting strip 4. The rotary joint 3 illustrated in FIG. 2 comprises a shaft member 3*a* fixed to the manipulating lever 1, a tubular member 3*b* engaged with a joint member 3*c* and a bolt member 3*d* screwed into the shaft member 3*a*, and is operative to convert a rotational motion of the manipulating lever 1 into a swing motion with a straight component of the connecting rod 4 together with the joint member 3*c*. The shaft member 3*a* and the tubular member 3*b* are rotational with respect to each other, and the bolt member 3*d* prevents the shaft member 3*a* and the tubular member 3*b* from disassembling. Namely, the bolt member 3*d* has a head portion 3*da* as large in diameter as the tubular member 3*b*, and restricts the rightward movement of the tubular member 3*b*. On the other hand, the shaft member 3*a* has a collar 3*aa* which is as large in diameter as the tubular member 3*b*. The collar 3*aa* restricts the leftward movement of the tubular member 3*b*.

Another prior art rotary joint 5 is shown in FIG. 3, and comprises a shaft member 5*a* fixed to the manipulating lever 1, a tubular member 5*b* engaged with a joint member 5*c* and washers 5*d* and 5*e*. The shaft member 5*a* and the tubular member 5*b* are rotatable with respect to each other, and the shaft member 5*a* is loosely inserted into the washers 5*d* and 5*e*. The leading end 5*aa* of the shaft member 5*a* is caulked, and is, accordingly, larger than the inside diameter of the washer 5*e*. With the caulked portion 5*aa*, the tubular member 5*b* is disassembled from the shaft member 5*a*.

It is important for the prior art link mechanism to promptly transmit force exerted on the manipulating lever 1 to the rotary valve 2, and smooth rotation of the tubular member 3*b* or 5*b* achieves the prompt transmission. As described hereinbefore, the tubular member 3*b* or 5*b* is restricted by the combination of the head portion 3*da* and the collar 3*aa* or by the washers 5*d* and 5*e*, and gaps G1/G2 or G3/G4 should be appropriately adjusted. However, the gaps G1 and G2 are hardly adjustable, because the total amount of gaps G1 and G2 are automatically given as difference between the length L1 of the shaft member 3*a* and the length L2 of the tubular member 3*b*. Dispersion unintentionally takes place during machining the shaft member 3*a* and the tubular member 3*b*, and the gaps G1 and G2 are hardly adjustable to appropriate values. Moreover, the shaft member 3*a* is brazed or soldered to the manipulating lever 1, and the brazing or the soldering is liable to make the collar 3*aa* out of order. For this reason, even though the side surface of the collar 3*aa* is precisely finished by using, for example, buff treatment or plating, the gaps G1 and G2 fluctuate, and readjustment is impossible. The prior art rotary joint 5 is more serious than the prior art rotary joint 3, because the caulked leading end 5*aa* never allows readjusting.

SUMMARY OF THE INVENTION

It is therefore an important object of the present invention provide a link mechanism incorporated in a wind instrument which smoothly transmits a lever action to a rotary valve unit or a key.

To accomplish the object, the present invention proposes to retain a tubular member by means of an internal thread and an external thread so as to regulate gaps.

In accordance with one aspect of the present invention, there is provided a transmission mechanism provided between a manipulating lever and a change-over means for changing a vibrative air column produced in a wind instrument, comprising: a) a joint means having a-1) a shaft member fixed to the manipulating lever, and having a collar portion and an external thread portion smaller in major diameter than the collar portion and projecting from the collar portion, a-2) an adjustable screw member having a head portion and a tubular portion smaller in major diameter than the head portion and projecting from the head portion, an internal thread being formed on an inner wall portion of the tubular portion, the external thread portion being engaged with the internal thread, a-3) a tubular member having a through hole allowing the tubular portion engaged with the external thread portion to pass therethrough, and tunable around the tubular portion engaged with the external thread portion for actuating the change-over means, and a-4) an elastic member inserted between a bottom surface of the tubular portion and a leading end of the external thread portion for eliminating a backlash between the external thread of the external thread portion and the internal thread.

In accordance with another aspect of the present invention, there is provided a transmission mechanism provided between a manipulating lever and a change-over means for changing a vibrative air column produced in a wind instrument, comprising: a) a joint means having a-1) a shaft member fixed to the manipulating lever, and having a collar portion and a tubular portion smaller in major diameter than the collar portion and projecting from the collar portion, the tubular portion having a hollow space defined by an inner wall portion with an internal thread, a-2) an adjustable screw member having a head portion and an external thread portion smaller in major diameter than the head portion and projecting from the head portion, the internal thread being engaged with the external thread portion, a-3) a tubular member having a through hole allowing the tubular portion engaged with the external thread portion to pass therethrough, and tunable around the tubular portion engaged with the external thread portion for actuating the change-over means, and a-4) an elastic member inserted between a bottom surface of the tubular portion and a leading end of the external thread portion for eliminating a backlash therebetween.

In accordance with yet another aspect of the present invention, there is provided a transmission mechanism provided between a manipulating lever and a change-over means for changing a vibrative air column produced in a tube member of a wind instrument, comprising: a) a joint means having a-1) a shaft member stationary with respect to the tube member, and having a collar portion, a journal portion smaller in major diameter than the collar portion and an external thread portion smaller in major diameter than the journal portion and projecting from the journal portion, a-2) an adjustable screw member having a head portion and a tubular portion smaller in major diameter than the head portion and projecting from the head portion, the tubular portion being as thick as the journal portion, the tubular portion having a hollow space defined by an inner wall portion thereof with an internal thread, the internal thread being engaged with the external thread portion, a-3) a tubular member having a through hole allowing the tubular portion engaged with the external thread portion to pass therethrough, and tunable around the tubular portion as well as the journal portion for actuating the change-over means when the manipulating lever is manipulated, and a-4) an elastic member inserted between a bottom surface of the tubular portion and a leading end of the external thread portion for eliminating a backlash therebetween.

BRIEF DESCRIPTION OF THE DRAWINGS

The feature and advantages of the brass instrument according to the present invention will be more clearly understood from the following description taken in conjunction with the accompanying drawings in which.

DESCRIPTION OF THE PREFERRED EMBODIMENTS

First Embodiment

Figure 1:
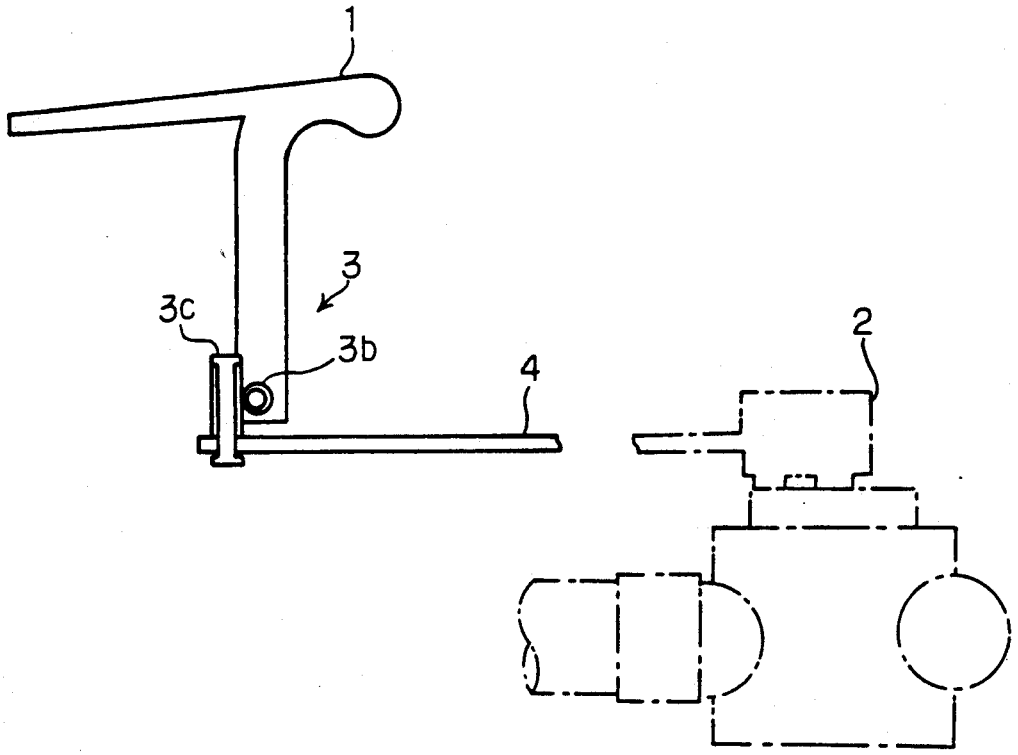
Fig. 1 PRIOR ART
FIG. 1 is a front view showing the arrangement of the prior art link mechanism incorporated in the brass instrument.
Figure 2:
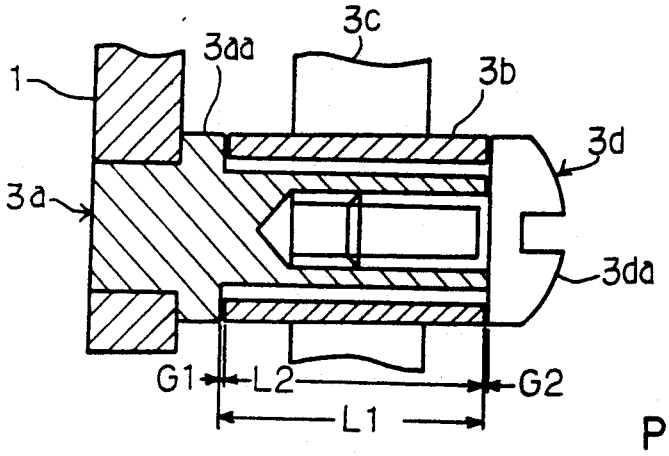
Fig. 2 PRIOR ART
FIG. 2 is a cross sectional view showing the structure of the rotary joint incorporated in the prior art link mechanism.
Figure 3:
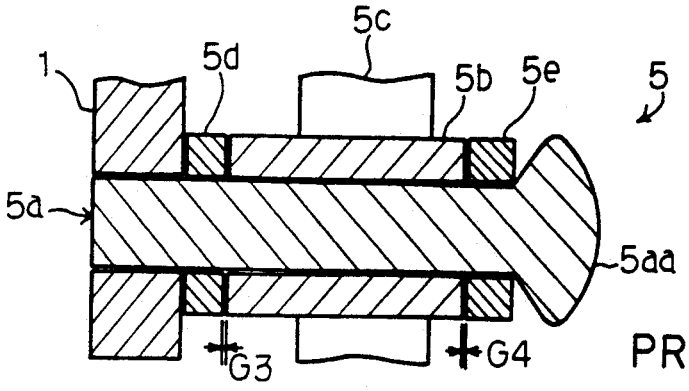
Fig. 3 PRIOR ART
FIG. 3 is a cross sectional view showing the structure of another prior art rotary joint.
Figure 4:
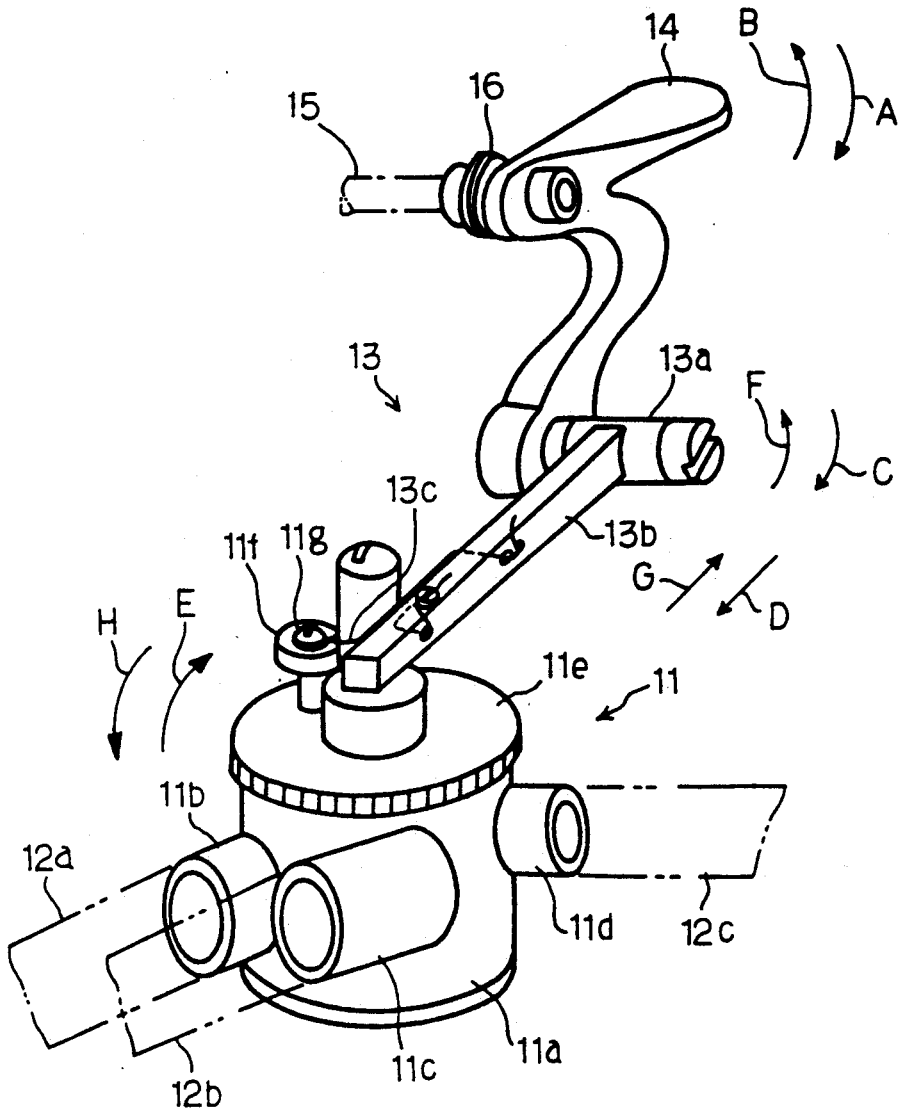
FIG. 4 is a perspective view showing the essential part of a wind instrument according to the present invention.

Referring to FIG. 4 of the drawings, a French horn embodying the present invention has a rotary valve unit 11 conducted to tube members 12*a*, 12*b* and 12*c*, and the rotary valve unit 11 selectively conducts the tube members 12*a* to 12*c* so as to change the length of vibrative air column created in the wind instrument. Although a plurality of rotary valve units are provided in association with tube members, only one rotary valve unit 11 is illustrated in FIG. 4. When the length of vibrative air column is changed, the tone is also changed, and, accordingly, a performer can create a music. The rotary valve unit 11 serves as a change-over means, and the link mechanism serves as a transmission mechanism.

The rotary valve unit 11 comprises a stationary valve casing 11*a* with three air ports 11*b*, 11*c* and 11*d*, and a rotatable valve body 11*e* with air passages (not shown), and the air passages of the rotatable valve body 11*e* selectively conduct the three air ports 11*b* to 11*d*. The three air ports 11*b* to 11*d* are respectively coupled with the tube members 12*a* to 12*c*, and the rotatable valve body 11*e* changes the length of vibrative air column through the rotation thereof. An anchor member 11*f* projects from the rotatable valve body 11*e*, and a bolt 11*g* is screwed into the anchor member 11*f*.

A link mechanism 13 is coupled between a manipulating lever 14 and the rotary valve unit 11, and the manipulating lever 14 is rotatably supported by a supporting rod 15. The manipulating lever 14 has a center axis substantially aligned with a center axis of the supporting rod 15, and is rotatable with respect to the center axis thereof upon being depressed in a direction indicated by an arrow A. A spring member 16 is provided for the manipulating lever 14, and urges the manipulating lever 14 in a direction indicated by an arrow B. Therefore, if the manipulating lever 14 is released, the manipulating lever 14 is driven for rotation in the direction indicated by the arrow B by means of the spring member 16, and is recovered from the depressed position to the home position thereof.

The link mechanism 13 largely comprises a rotary joint 13*a* coupled with the manipulating lever 14, a connecting rod 13*b* coupled with the rotary joint 13*a*, and a flexible string 13*c*. The flexible string 13*c* is coupled at one end thereof with the connecting rod 13*b*, and passes through the anchor member 11*f*. The other end of the flexible string 13*c* is also coupled with the connecting rod 13*b*.

The link mechanism 13 thus arranged behaves as follows. When the manipulating lever 14 is depressed, the manipulating lever 14 turns in the direction indicated by the arrow A, and the rotary joint 13*a* converts a rotational motion indicted by an arrow C into a swing motion with a straight component indicated by an arrow D. The straight component indicated by the arrow D is converted into a rotational motion E of the rotational valve body 11*e* again by means of the flexible string 13*c*, and the rotational valve body 11*e* allows the air passages to conduct different two of the air ports 11*b* to 11*d*.

If the manipulating lever 14 is released, the spring member 16 allows the manipulating lever 14 to turn in the direction indicated by the arrow B, and the rotary joint 13*a* changes a rotational motion. F into a swing motion with a straight component indicated by an arrow G. The straight component indicated by the arrow G is converted into a rotational motion indicated by an arrow H again by the flexible string 13*c*, and the rotational valve body 11*e* conducts the initial two air ports.

Figure 5:
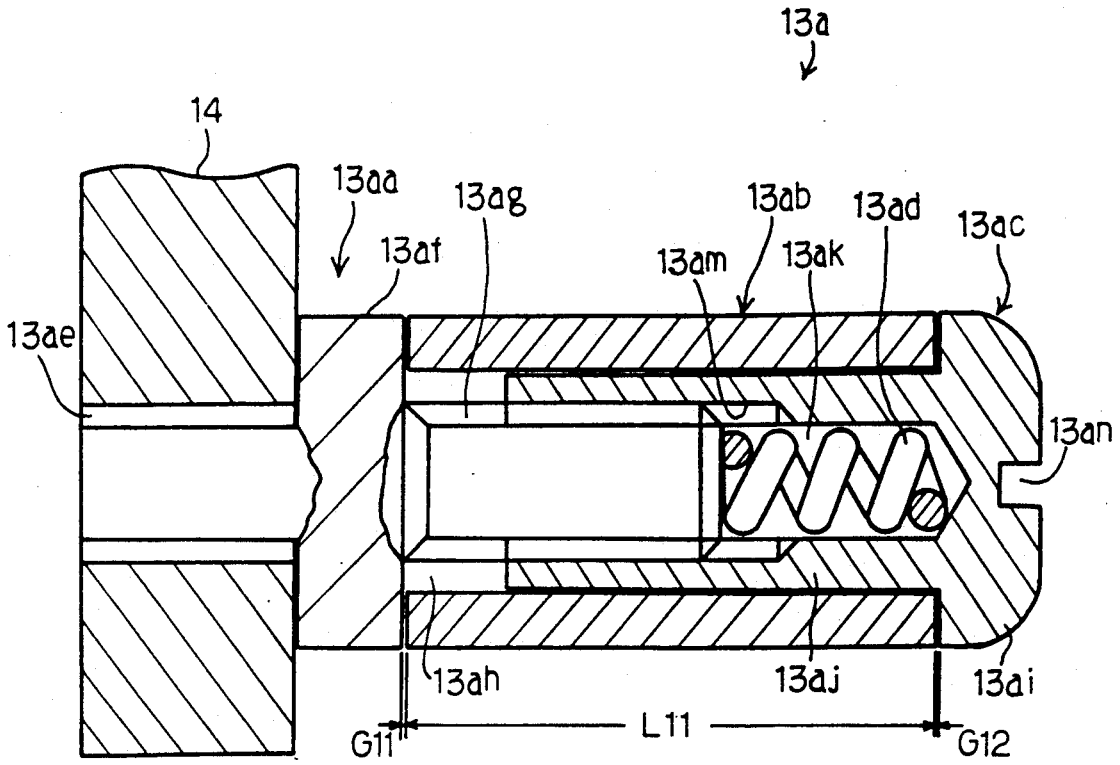
FIG. 5 is a cross sectional view showing the structure of a rotary joint incorporated in the wind instrument shown in FIG. 4.

The arrangement of the rotary joint 13*a* is illustrated in FIG. 5 in an enlarged scale, and largely comprises a shaft member 13*aa*, a tubular member 13*ab*, an adjustable screw member 13*ac*, and a coil spring 13*ad*. The shaft member 13*aa* has a first screw portion 13*ae* screwed into the manipulating lever 14, a collar 13*af* and a second screw portion 13*ag* projecting from the collar 13*af*. The collar 13*af* is larger in diameter than the first and second screw portions 13*ae* and 13*ag*, and is as large as the major diameter of the tubular member 13*ab*. The inside diameter of the tubular member 13*ab* is larger than the second screw portion 13*ag*, and hollow space 13*ah* takes place between the second screw portion 13*ag* and the tubular member 13*ab*. The adjustable screw member 13ac has a head portion 13ai and a stem portion 13aj projecting from the head portion 13ai, and the major diameter of the stem portion 13aj is slightly smaller than the inside diameter of the tubular member 13ab. For this reason, the stem portion 13aj is insertable into the hollow space 13ah. A cylindrical concave 13a is formed in the stem portion 13aj, and is contiguous to a cylindrical through hole 13am open at the leading end of the stem portion 13aj. The coil spring 13ad is accommodated in the cylindrical concave 13a, and an internal thread is formed along the inner wall portion defining the cylindrical through hole 13am. The internal thread is meshed with the second screw portion 13ag, and the adjustable screw member 13ac is screwed when being driven for rotation. The leading end of the second screw portion 13ah advances toward the bottom surface of the cylindrical concave 13a against the elastic force of the coil spring 13ad, and the coil spring 13ad eliminates backlash between the second screw portion and the internal thread. A groove 13an is formed in the adjustable screw member 13ac, and a person inserts a screw driver into the groove 13an for turning the adjustable screw member 13ac, thereby adjusting gaps G11 and G12 to appropriate values. Although the length L11 of the tubular member 13ab is not strictly constant, the distance between the collar 13af and the head portion 13ai is variable, and the gaps G11 and G12 are adjustable at any time, i.e., upon completion of the French horn as well as after delivery from the factory. This results in that the tubular member 13ab smoothly turns around the stem portion 13aj, and the rotary joint 13a can transmit an action of the manipulating lever 14 to the connecting rod 13b. Moreover, the adjustable screw member 13ab allows a person to keep the rotary joint 13a excellent, because oil reaches a gap between the inner surface of the tubular member 13ab and the outer surface of the stem portion 13aj through expanded gaps G11 and G12.

Second Embodiment

Figure 6:
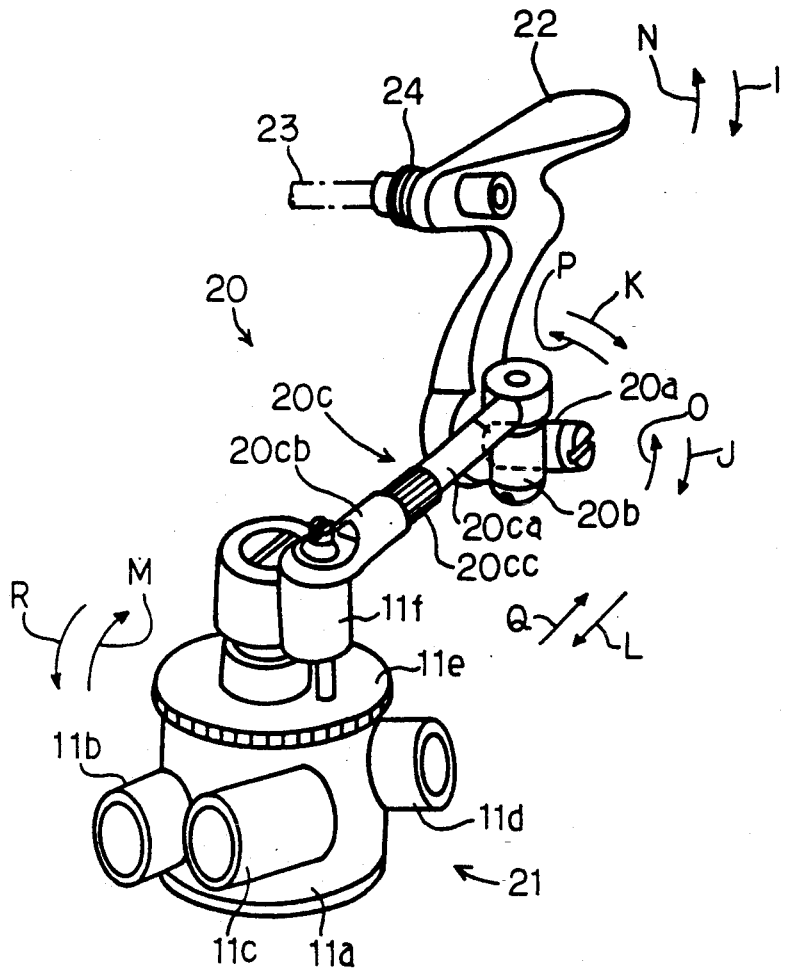
FIG. 6 is a perspective view showing the arrangement of another link mechanism according to the present invention.

Turning to FIG. 6 of the drawings, another link mechanism 20 embodying the present invention is provided in association with a rotary valve unit 21 incorporated in a brass instrument. The rotary valve unit 21 is similar in structure to the rotary valve unit 11, and, for this reason, parts of the rotary valve unit 21 are labeled with the same references designating the corresponding part of the rotary valve unit 11.

The link mechanism 20 implementing the second embodiment is coupled with a manipulating lever 22 rotatably supported by a supporting rod 23, and the manipulating lever 22 is urged by a spring unit 24. The link mechanism 20 comprises a first rotary joint 20a fixed to the manipulating lever 22, a second rotary joint 20b coupled with the first rotary joint 20a, and a connecting rod 20c coupled between the second rotary joint 20b and the anchor member 11f of the rotary valve unit 21. The first rotary joint 20a crosses the second rotary joint 20b at right angle, and both first and second rotary joints 20a and 20b are similar in structure to the rotary joint 13a. For this reason, no further description is incorporated hereinbelow for the sake of simplicity.

The shaft member of the first rotary joint 20a is screwed into the manipulating lever 22 and brazed thereto. The tubular member of the first rotary joint 20a is also brazed to the tubular member of the second rotary joint 20b at right angle, and the shaft member of the second rotary joint 20b is brazed to one end of the connecting rod 20c. The adjustable screw members of the first and second rotary joints 20a and 20b are used for adjusting gaps on both sides of the tubular members as similar manner to the rotary joint 13a.

The connecting rod 20c comprises a rod member 20ca with an external thread at the opposite end portion, a second tubular member 20cb with an internal thread on the inner wall portion thereof, and a nut member 20cc screwed into the external thread. The rod member 20ca is screwed into the tubular member 20cb for adjusting the total length to the distance between the second rotary joint 20b and the anchor member 11f at home portion thereof, and the nut member 20cc is pressed against the tubular member 20cb so that the total length is not unintentionally changed.

The link mechanism 20 thus arranged behaves as follows. When the manipulating lever 22 is depressed, the manipulating lever 22 turns in the direction indicated by the arrow I, and the first rotary joint 20a rotates in a direction indicted by an arrow J. The rotation indicated by the arrow J produces a swing motion with a rotational component indicated by an arrow K and a straight component indicated by an arrow L, and the second rotary joint 20b and the connecting rod 20c move in the respective directions K and L. The straight component indicated by the arrow L produces a rotational motion indicated by an arrow M for the rotational valve body 11e, and the rotational valve body 11e conducts different two of the air ports 11b to 11d.

If the manipulating lever 22 is released, the spring unit 24 allows the manipulating lever 22 to turn in a direction indicated by an arrow N, and the rotary joint 13a rotates in a direction indicated by an arrow 0. The rotation indicated by the arrow 0 produces a swing motion with a rotational component indicated by an arrow P and a straight component indicated by an arrow Q. The straight component indicated by the arrow Q allows the valve body 11e to rotate in a direction indicated by an arrow R, and the rotational valve body 11e conducts the initial two air ports again.

Thus, the first and second rotary joints 20a and 20b provided at right angle achieves the same advantages as the first embodiment, and allows a designer to fabricate the link mechanism 20 from metallic components. The link mechanism 20 is applicable to a trombone with rotary valve units, a rotary trumpet and a rotary tuba.

Third Embodiment

Figure 7:
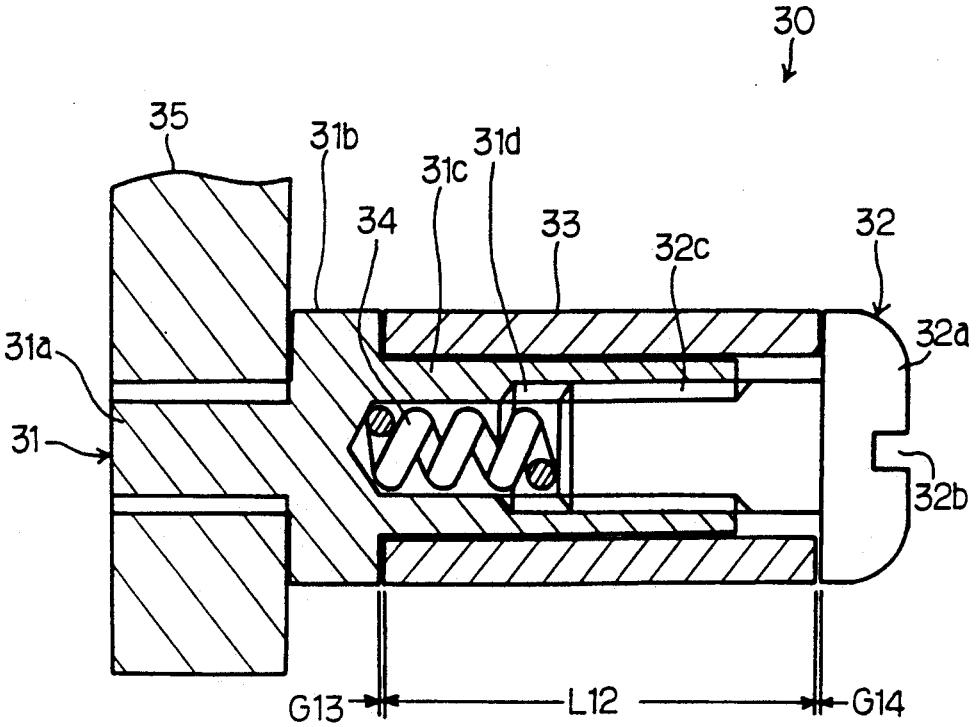
FIG. 7 is a cross sectional view showing the structure of a rotary joint incorporated in another wind instrument according to the present invention.

Turning to FIG. 7 of the drawings, yet another rotary joint 30 embodying the present invention is illustrated. Though not shown in the drawings, the rotary joint is provided in association with a rotary valve unit incorporated in a wind instrument.

The rotary joint 30 largely comprises a shaft member 31, an adjustable screw member 32, a tubular member 33 and a coil spring 34. The shaft member 31 has a first external thread portion 31a engaged with an internal thread formed in a manipulating lever 35, a collar 31b, and a tubular portion 31c smaller in major diameter than the collar 31b. A hollow space is defined by an inner wall portion of the tubular portion 31c, and an internal thread 31d is formed on the inner wall portion. The adjustable screw member 32 has a head portion with a groove 32b, and an external thread portion 32c smaller in major diameter than the head portion 32a and engaged with the internal thread of the tubular portion 31c. The tubular member 33 has an inside diameter slightly larger than the major diameter of the tubular portion 31c, and is tunable around the tubular portion 31c. Though not shown in the drawings, the tubular member 33 is connectable with a rotary valve unit through an appropriate connecting rod. The coil spring 34 is inserted into the hollow space formed in the tubular portion 31c, and is pressed against the bottom surface of the tubular portion 31c by the leading end of the adjustable screw member 32. The elastic force produced by the coil spring 34 eliminates the backlash between the internal thread and the external thread.

When the adjustable screw member 32 turns, the distance between the collar 31b and the head portion 32a is increased or decreased depending upon the rotational direction, and gaps G13 and G14 are adjusted to appropriate values. Even if the length L12 of the tubular member 33 is not strictly constant, the gaps G13 and G14 are adjusted to the appropriate values, and allow the tubular member 33 to smoothly turn. The other advantages of the first embodiment are also achieved by the rotary joint 30.

Fourth Embodiment

Figure 8:
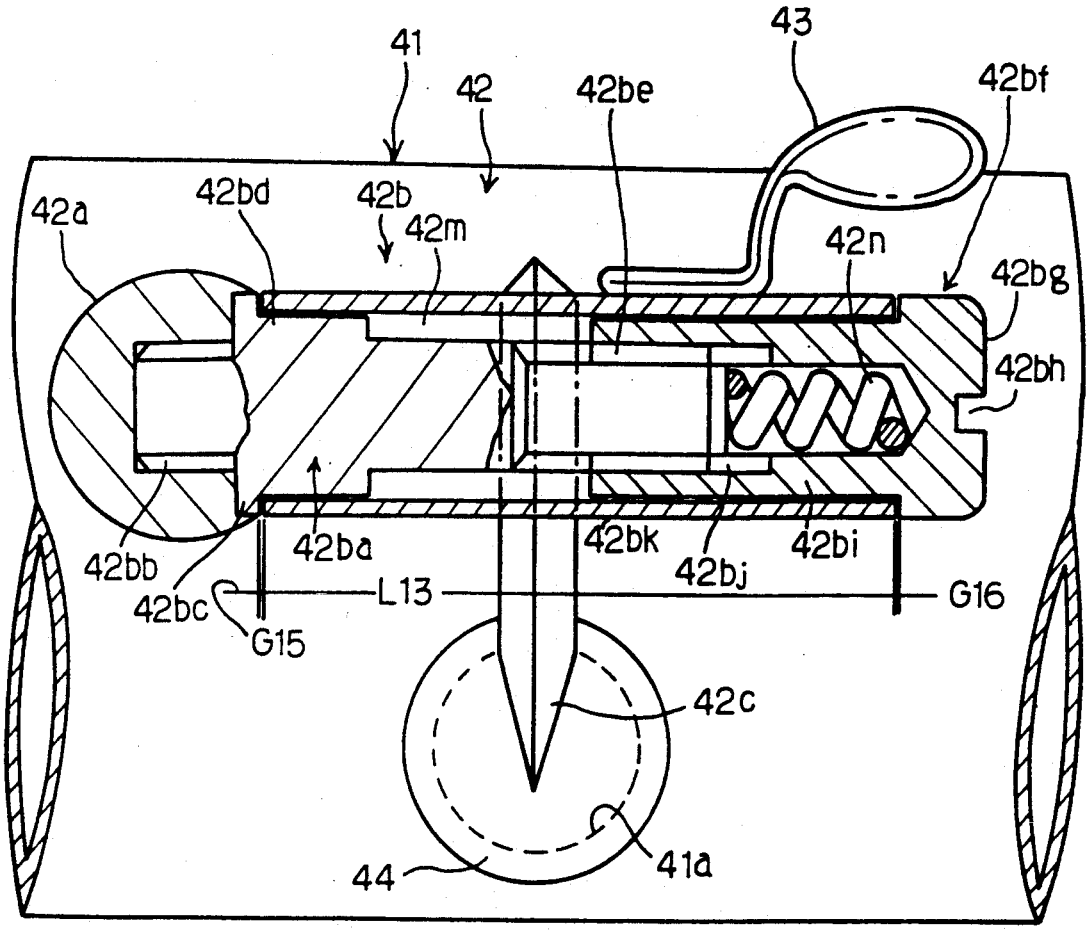
FIG. 8 is a cross sectional view showing the structure of a clarinet according to the present invention.

Turning to FIG. 8 of the drawings, a clarinet embodying the present invention largely comprises a tube member 41 allowing a vibrative air column to take place, and a key mechanism 42 provided between a manipulating lever 43 and a key member 44. The key member 44 is actuated with the manipulating lever 43, and opens and closes a tone hole 41a formed in the tube member 41. The key mechanism 42 serves as a transmission mechanism, and the key member 44 serves as a change-over means.

The key mechanism 42 comprises a key post 42a projecting from the tube member 41, a rotary joint 42b fixed to the key post in a cantilever fashion, and a connecting rod 42c connected between the rotary joint 42b and the key 44.

The rotary joint 42b comprises a shaft member 42ba having a first external thread portion 42bb engaged with the key post 42a, a collar 42bc, a journal portion 42bd smaller in major diameter than the collar 42bc and a second external thread portion 42be smaller in major diameter than the journal portion 42bd, an adjustable screw member 42bf having a head portion 42bg with a groove 42bh and a tubular portion 42bi with an internal thread on the inner surface thereof, a tubular member having a through hole 42m allowing the second external thread portion 42be and the tubular portion 42bi to pass therethrough and an inside diameter slightly larger than the major diameters the journal portion 42bd and the tubular portion 42bi, and a coil spring 42n pressed against a bottom surface of the tubular portion 42bi by means of the shaft member 42ba. the manipulating lever 43 and the connecting rod 42c are coupled with the tubular member 42bk.

Since the first external thread portion 42bb is engaged with the internal thread of the key post 42a, the shaft member 42ba is stationary with respect to the tube member 41, and allows the tubular member 42bk to rotate around the journal portion 42bd and the tubular portion 42bk when the manipulating lever 43 is depressed.

Though not shown in the drawings, a spring member is provided in association with the key member 44, and urges the key member 44 to close the tone hole 41a. However, if a player depresses the manipulating lever 43, the manipulating lever 43 allows the tubular member 42bk and accordingly, the key member 44 to turn, and the tone hole is open to change the length of the vibrative air column and the tone.

The rotary joint 42b is expected to smoothly transmit the lever action to the key member 44, and gaps G15 and G16 are adjustable by turning the adjustable screw member 42bf. Namely, even if the length L13 of the tubular member 42bk is slightly increased or decreased, the distance between the collar 42bc and the head portion 42bg is variable, and the gaps G15 and G16 are adjusted to appropriate values at any times. The tube member 41 of the clarinet is made of wood, and the dimensions are liable to be changed due to aged deterioration. However, the adjustable screw member a player can manipulate the lever 43 comfortably.

Fifth Embodiment

Figure 9:
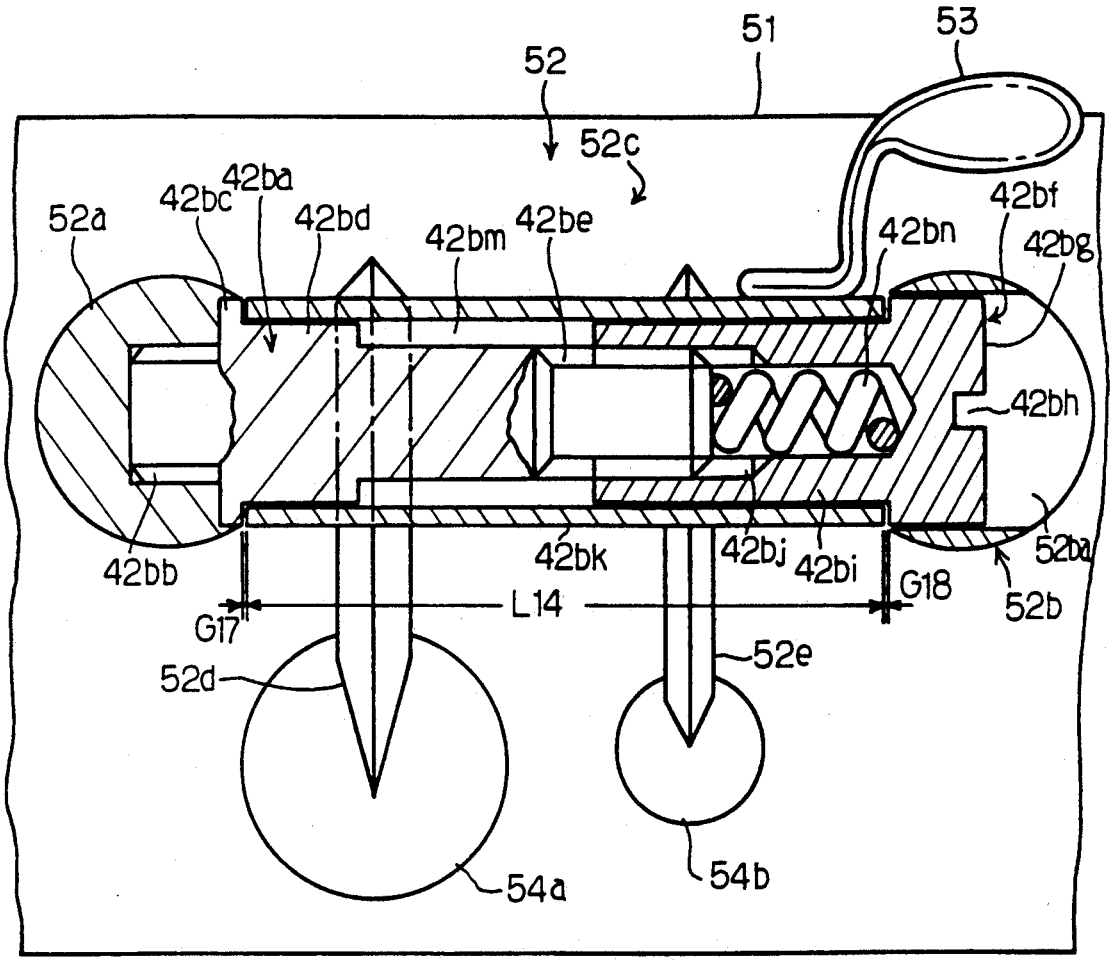
FIG. 9 is a cross sectional view showing the structure of a woodwind instrument according to the present invention.

Turning to FIG. 9 of the drawings, a woodwind instrument embodying the present invention largely comprises a tube member 51, and a key mechanism 52 coupled between a manipulating lever 53 and two key members 54a and 54b. The key mechanism 52 comprises a pair of posts 52a and 52b, a rotary joint 52c and two connecting rods 52d and 52e coupled with the key members 54a and 54b, respectively. The rotary joint 52c is similar in structure to the rotary joint 42b, and component parts thereof are labeled with the same references used in FIG. 8 without any detailed description.

The rotary joint 52c is bridged between the pair of key posts 52a and 52b, and a groove 52ba is formed in the key post 52b. The groove 52ba is as wide as the head portion 42bg of the adjustable screw member 42bf, and allows the adjustable screw member 42b to turn in the groove 52ba. However, the head portion 42bg is supported by the key post 52b, and no excess force is exerted to the first external thread portion 42bb.

The rotary joint 52c achieves the similar advantages. Namely, even if the length L14 of the tubular member 42bk is increased or decreased, the distance between the collar 42bc and the head portion 42bg is changed through rotation of the adjustable screw member 42bf, and gaps G17 and G18 are adjusted to appropriate values at any times. In this instance, when the manipulating lever 53 is depressed by a player, the key members are concurrently driven for rotation against a spring member (not shown), and tone holes are simultaneously open.

The key mechanisms implementing the fourth and fifth embodiments are applicable to any woodwind instrument such as, for example, a saxohorn, a flute, an oboe or a bassoon.

Although particular embodiments of the present invention have been shown and described, it will be obvious to those skilled in the art that various changes and modifications may be made without departing from the spirit and scope of the present invention.

What is claimed is:

1. A transmission mechanism provided between a manipulating lever and a change-over means for changing a vibrative air column produced in a wind instrument, comprising:

a) a joint means having a-1) a shaft member fixed to said manipulating lever, and having a collar portion and an external thread portion smaller in major diameter than said collar portion and projecting from said collar portion, a-2) an adjustable screw member having a head portion and a tubular portion smaller in major diameter than said head portion and projecting from said head portion, an internal thread being formed on an inner wall portion of said tubular portion, said external thread portion being engaged with said internal thread, a-3) a tubular member having a through hole allowing said tubular portion engaged with said external thread portion to pass therethrough, and tunable around said tubular portion engaged with said external thread portion for actuating said change-over means, and a-4) an elastic member inserted between a bottom surface of said tubular portion and a leading end of said external thread portion for eliminating a backlash between the external thread of said external thread portion and said internal thread.

2. A transmission mechanism as set forth in claim 1, in which said change-over means is implemented by a rotary valve unit having a stationary valve casing with a plurality of air ports, and a valve body rotatable with respect to said stationary valve casing for selectively conducting said plurality of air ports.

3. A transmission mechanism as set forth in claim 2, in which said transmission mechanism further comprises b) a connecting rod coupled with said tubular member, and c) a flexible string coupled at both ends thereof with said connecting rod and engaged with said valve body for causing said valve body to turn with respect to said stationary valve casing.

4. A transmission mechanism as set forth in claim 2, in which said transmission mechanism further comprises b) a second joint means similar in structure to said joint member and fixed to the tubular member of said joint means at substantially right angle, and c) a connecting rod coupled between said second joint means and said valve body.

5. A transmission mechanism provided between a manipulating lever and a change-over means for changing a vibrative air column produced in a wind instrument, comprising:

a) a joint means having a-1) a shaft member fixed to said manipulating lever, and having a collar portion and a tubular portion smaller in major diameter than said collar portion and projecting from said collar portion, said tubular portion having a hollow space defined by an inner wall portion with an internal thread, a-2) an adjustable screw member having a head portion and an external thread portion smaller in major diameter than said head portion and projecting from said head portion, said internal thread being engaged with said external thread portion, a-3) a tubular member having a through hole allowing said tubular portion engaged with said external thread portion to pass therethrough, and tunable around said tubular portion engaged with said external thread portion for actuating said change-over means, and a-4) an elastic member inserted between a bottom surface of said tubular portion and a leading end of said external thread portion for eliminating a backlash therebetween.

6. A transmission mechanism provided between a manipulating lever and a change-over means for changing a vibrative air column produced in a tube member of a wind instrument, comprising:

a) a joint means having a-1) a shaft member stationary with respect to said tube member, and having a collar portion, a journal portion smaller in major diameter than said collar portion and an external thread portion smaller in major diameter than said journal portion and projecting from said journal portion, a-2) an adjustable screw member having a head portion and a tubular portion smaller in major diameter than said head portion and projecting from said head portion, said tubular portion being as thick as said journal portion, said tubular portion having a hollow space defined by an inner wall portion thereof with an internal thread, said internal thread being engaged with said external thread portion, a-3) a tubular member having a through hole allowing said tubular portion engaged with said external thread portion to pass therethrough, and tunable around said tubular portion as well as said journal portion for actuating said change-over means when said manipulating lever is manipulated, and a-4) an elastic member inserted between a bottom surface of said tubular portion and a leading end of said external thread portion for eliminating a backlash therebetween.

7. A transmission mechanism as set forth in claim 6, in which said transmission mechanism further comprises a keypost projecting from said tube member and fixed to said shaft member in a cantilever fashion, and a connecting rod coupled between said tubular member and said key, said manipulating lever being coupled with said tubular member.

8. A transmission mechanism as set forth in claim 6, in which said transmission mechanism further comprises a pair of key posts spaced from each other and projecting from said tube member, and a connecting rod coupled between said tubular member and said key, said manipulating lever being coupled with said tubular member, said shaft member being fixed to one of said pair of key posts, said adjustable screw member being rotatably supported by the other of said pair of key posts.

* * * * *